US007370584B2

(12) United States Patent
Johnson et al.

(10) Patent No.: US 7,370,584 B2
(45) Date of Patent: May 13, 2008

(54) SECOND ENVIRONMENT SENSING IN SMART BOMBS

(75) Inventors: Michael A. Johnson, Chaska, MN (US); Kenneth Ceola, Prior Lake, MN (US)

(73) Assignee: Alliant Techsystems Inc., Edina, MN (US)

( * ) Notice: Subject to any disclaimer, the term of this patent is extended or adjusted under 35 U.S.C. 154(b) by 399 days.

(21) Appl. No.: 10/858,809

(22) Filed: Jun. 2, 2004

(65) Prior Publication Data

US 2008/0047451 A1 Feb. 28, 2008

(51) Int. Cl.
*F42C 15/40* (2006.01)

(52) U.S. Cl. ..... 102/221; 102/237; 102/382; 102/215; 102/262

(58) Field of Classification Search ..... 102/215, 102/221, 222, 231, 232, 238, 382, 262, 264; 89/1.55

See application file for complete search history.

(56) References Cited

U.S. PATENT DOCUMENTS 3,750,583 A * 8/1973 White et al. ..... 102/221
3,850,102 A * 11/1974 Morrow ..... 102/210
4,541,341 A 9/1985 Fowler et al. ..... 102/215
4,641,801 A 2/1987 Lynch, Jr. et al. ..... 244/3.14
4,691,105 A 9/1987 Huffnagle ..... 256/338
4,796,532 A 1/1989 Webb ..... 102/233
5,497,704 A 3/1996 Kurschner et al. ..... 102/264
5,705,766 A 1/1998 Farace et al. ..... 102/215
6,295,931 B1 10/2001 Cutler et al. ..... 102/221
6,295,932 B1 * 10/2001 Kane, III ..... 102/221
6,540,176 B2 * 4/2003 Davis et al. ..... 244/3.24
6,896,220 B2 * 5/2005 McKendree et al. ..... 244/3.15
6,951,161 B2 * 10/2005 Ceola ..... 89/6.5

* cited by examiner

*Primary Examiner*—James S Bergin
(74) *Attorney, Agent, or Firm*—Vidas, Arrett & Steinkraus, P.A.

(57) ABSTRACT

A safety and arming apparatus for arming a fuze of a smart weapon comprise a release sensor and a verification maneuver sensor in cooperative electronic communication with each other, such that when the release sensor senses that the weapon has been released and the verification maneuver sensor detects a predetermined verification maneuver of the weapon in flight, the fuze is armed.

16 Claims, 1 Drawing Sheet

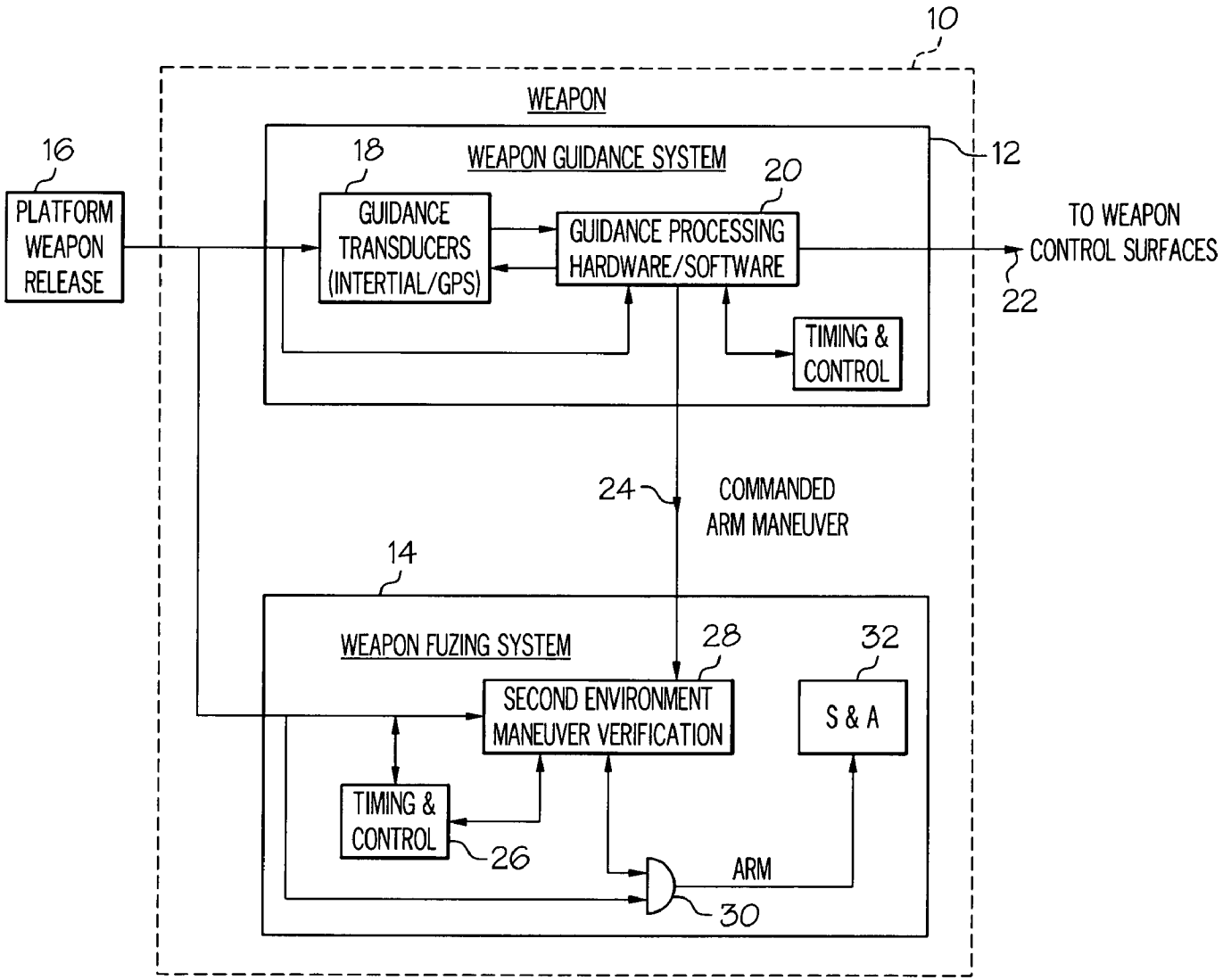
10
WEAPON
12
WEAPON GUIDANCE SYSTEM
GUIDANCE TRANSDUCERS (INTERTIAL/GPS)
18
GUIDANCE PROCESSING HARDWARE/SOFTWARE
20
TIMING & CONTROL
TO WEAPON CONTROL SURFACES
22
PLATFORM WEAPON RELEASE
16
COMMANDED ARM MANEUVER
24
14
WEAPON FUZING SYSTEM
SECOND ENVIRONMENT MANEUVER VERIFICATION
28
TIMING & CONTROL
26
S & A
32
ARM
30

SECOND ENVIRONMENT SENSING IN SMART BOMBS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

A safety and arming device is a required element of a munition to ensure that the munition is not armed and detonated until the desired time. The safety and arming device (S&A) is part of a munition's fuze and prevents arming of the fuze until certain conditions are met.

MTL-STD-1316E is a standard which establishes specific design safety criteria for fuzes. It applies primarily to the safety and arming functions performed by fuzes for use with munitions. The safety and arming requirements, which are well documented, are mandatory fundamental elements of design, engineering, production and procurement for fuzes. Fuzes are to be provided with safety that is consistent with assembly, handling, storage, transportation and disposal. Munition fuzes historically have utilized sensitive explosive elements whose output has been physically interrupted until arming. Control of the arming process in these fuzes was accomplished by mechanical means.

MIL-STD-1316E requires that two unique environments or occurrences to be sensed prior to fuze arming. For gun fired weapons, sensors may be provided to sense environments such as setback acceleration and spin rate.

For bomb fuzes, the release does not provide for the unique conditions such as are experienced by a munition during gun firing. Bombs differ from gun fired weapons in that they are released to their target and are predominantly gravity driven, as opposed to being fired via an explosion or driven by constant thrust. Typically, past bomb fuzing approaches have relied on mechanically/electrically sensing the weapon's release as a first detectable environment, followed by the detection of air flow over a release exposed turbine as a second environment to verify intentional launch. These release scenarios combined with a ballistic fall made the turbine approach acceptable. With modern weapons however, particularly with munitions such as "smart weapons," the turbine approach for detecting a second environment has significant drawbacks.

It is thus a goal of at least one embodiment of the present invention to provide a smart weapon, such as a smart bomb, with a second environment sensor that avoids the need for a turbine approach and instead takes advantage of the unique flight characteristics of the smart weapon, increase safety and satisfy—MIL-STD-1316.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

A smart bomb or weapon contains or includes a guidance system and control surfaces which provide the weapon with the ability to maneuver independently or by an operator's direction. The present invention seeks to take advantage of the smart weapon's maneuverability to provide the weapon with a unique second environment fuzing sensor.

In some embodiments of the invention a smart weapon equipped with a guidance system may be commanded to execute a verification maneuver subsequent to the weapons release. The verification maneuver will typically consist of a rotational motion with respect to the centerline of the weapon. Examples of verification maneuvers include but are not limited to: partial rolls, full rolls at various rates, defined sequences of rolls, rapid rolls, sustained spinning or some combination thereof. The maneuver will be unique to the weapon in free flight and not attainable while captive in the delivery vehicle (aircraft).

In at least one embodiment of the invention, only upon release from the aircraft are the control surfaces of the weapon capable of moving as required to induce the verification maneuver, as the aircraft carriage system contains a control surface mechanical block.

In some embodiments the weapon fuze will contain a maneuver sensor or roll sensor to independently verify the maneuver characteristics, such as rotational rate, direction, associated time from release and/or other profile characteristics as commanded by the smart weapon. Verification via the fuze mounted sensor eliminates concerns of distributed fuzing associated with maneuver verification by the guidance system. As a result maneuver verification by the guidance system may then be employed solely for redundancy purposes. See U.S. Pat. No. 5,497,704 as one example of a maneuver sensor, the entire contents of which are hereby incorporated by reference.

In embodiments where a rapid rate of spin is used as the verification maneuver, verification of spin up and subsequent de-spin could be profiled by both the weapon and fuze maneuver sensor. These maneuvers are such that duplication by the delivering platform is not physically possible.

Upon sensing both the release, as the first detectable environment, and the recognition of the predetermined maneuver profile in the time window post release defined by the smart weapon, as the second detectable environment, the weapon will be armed. In some embodiments of the invention, the verification maneuver may be required to be continuous at least until safe separation has been verified.

These and other embodiments which characterize the invention are pointed out with particularity in the claims annexed hereto and forming a part hereof However, for a better understanding of the invention, its advantages and objectives obtained by its use, reference should be made to the drawings which form a further part hereof and the accompanying descriptive matter, in which there is illustrated and described a preferred embodiment to the invention.

BRIEF DESCRIPTION OF THE SEVERAL VIEWS OF THE DRAWINGS

Referring to the Drawings, wherein like numerals represent like parts throughout the several views:

FIG. 1 is a block diagram of the safety and arming apparatus of the invention.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated. The concepts described above are considered to be read into the further description below.

Referring now to FIG. 1, a block diagram of a smart bomb is shown, with the smart bomb generally shown at 10. The smart bomb is divided into two conceptual sections, the weapon guidance system, shown at 12 and the weapon fuzing system, shown at 14.

Both the weapon guidance system 12 and the weapon fuze system 14 receive an input upon the platform weapon release, shown at 16, which functions as a first environment signal.

The weapon guidance system 12 is comprised of guidance transducers (inertial/GPS) block 18, which is well known in the prior art. There is two way communication between the guidance transducers block 18 and the guidance processing hardware/software block 20, which controls the weapon control surfaces at output 22, as is well known in the prior art.

Prior to arming, the guidance processing block 20 will command a verification maneuver, which will then be used as a second environment. The commanded arm maneuver is shown at 24, which represents a signal representative of the type of verification maneuver which guidance processing block 20 has commanded the smart bomb to perform via 22, to verify it is safe to arm the weapon. Verification maneuvers could consist of a partial roll, a full roll or rolls at various rates, a defined sequence of rolls, rapid rolls, sustained spinning or some combination thereof The weapon fuzing system 14 is comprised of a timing/control block 26, which starts timing upon platform weapon release; a second environment maneuver verification block 28; AND gate 30, which outputs to the safety and arming block 32.

The commanded ARM maneuver 24 is input to the second environment maneuver verification block 28, which includes a maneuver sensor, such as the one disclosed in U.S. Pat. No. 5,497,704 or other commercially available roll sensor, which is used to verify that the commanded maneuver actually takes place. If the commanded maneuver is verified, the output of block 28 goes high to AND gate 30. If both inputs to AND gate 30 are high (maneuver verified and weapon release or other first environment verified) than the output to the safety and arming block goes high to arm the weapon, as is well known in the prior art.

Optionally, the second environment maneuver verification block 28 can be configured to only output a high signal to AND gate 30 if the commanded maneuver occurs within a predetermined time window, using the timing block 26, which is input to block 28.

While not specifically detailed, it will be understood that the various electronic functional blocks are properly connected to appropriate bias and reference supplies so as to operate in their intended manner. It should also be understood that the processing described herein utilizes well known technology. Further, any circuitry configurations and applications thereof other than as described herein can be configured within the spirit and intent of this invention.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A weapon system comprising:

a smart bomb, the smart bomb comprising:

a guidance system; and a safety and arming apparatus for arming a fuze of a smart bomb, the safety and arming apparatus comprising:

a release sensor and a verification maneuver sensor;

wherein the guidance system commands the weapon to execute a predetermined verification maneuver that is required for arming, and the release sensor is in cooperative electronic communication with the verification maneuver sensor, such that when the release sensor senses that the weapon has been released and the verification maneuver sensor detects the predetermined verification maneuver of the weapon in flight the fuze is armed.

2. The weapon system of claim 1, wherein the verification maneuver is a predetermined set of partial rolls.

3. The weapon system of claim 1, wherein the verification maneuver is a predetermined rate of rotation.

4. The weapon system of claim 1, wherein the verification maneuver is a defined sequence of rolls.

5. The weapon system of claim 1, wherein the verification maneuver is sustained spinning.

6. The weapon system of claim 1, wherein the bomb utilizes control surfaces to achieve the verification maneuver.

7. The weapon system of claim 1, wherein the verification maneuver is determined by the direction and associated time from release.

8. The weapon system of claim 1, the guidance system comprising a second verification maneuver sensor, which further verifies the verification maneuver.

9. The weapon system of claim 1, wherein the verification maneuver is the termination or reversal of a sustained spinning.

10. The weapon system of claim 1, wherein the verification maneuver is a spin-up and a subsequent de-spin.

11. The weapon system of claim 1, wherein the verification maneuver is sustained predetermined maneuver and a predetermined distance from launch.

12. The weapon system of claim 1, further including a timer, which is initiated upon release, and further wherein the weapon is armed only if the verification maneuver occurs within a predetermined time from release.

13. The weapon system of claim 1, wherein the predetermined verification maneuver is commanded after the release system senses that the weapon has been released.

14. The weapon system of claim 1, wherein the verification maneuver sensor detects rotation around a longitudinal axis of the smart bomb.

15. The weapon system of claim 1, wherein the verification maneuver sensor comprises:

(a) a counting mechanism for counting a predetermined number of rotations of the weapon as it rotates around its longitudinal axis, the counting mechanism comprising:

(i) a spin signal mechanism for generating a spin signal which varies over time as the weapon rotates about its axis in the earths magnetic field and where the magnitude of the spin signal reaches a predetermined threshold a predetermined number of times for each said rotation of the weapon; and (ii) a counter operatively connected to the spin signal mechanism for counting the number of times the spin signal reaches its predetermined threshold; and (b) a spin rate computation mechanism for determining a spin rate of the weapon, wherein the spin rate computation mechanism is comprised of a timing mechanism operatively connected to the counter for determining the time for the weapon to rotate a predetermined number of times.

16. A weapon system comprising:

a smart bomb, the smart bomb comprising:

a guidance system that commands the smart bomb to execute a predetermined verification maneuver; and a safety and arming apparatus for arming a fuze of a smart bomb, the safety and arming apparatus comprising:

a release sensor and a verification maneuver sensor, the release sensor in cooperative electronic communication with the verification maneuver sensor, such that when the release sensor senses that the weapon has been released and the verification maneuver sensor detects said predetermined verification maneuver of the weapon in flights the fuze is armed;

wherein the verification maneuver sensor comprises:

(a) a counting mechanism for counting a predetermined number of rotations of the weapon as it rotates around its longitudinal axis, the counting mechanism comprising:

(i) a spin signal mechanism for generating a spin signal which varies over time as the weapon rotates about its axis in the earths magnetic field and where the magnitude of the spin signal reaches a predetermined threshold a predetermined number of times for each said rotation of the weapon; and (ii) a counter operatively connected to the spin signal mechanism for counting the number of times the spin signal reaches its predetermined threshold; and (b) a spin rate computation mechanism for determining a spin rate of the weapon, wherein the spin rate computation mechanism is comprised of a timing mechanism operatively connected to the counter for determining the time for the weapon to rotate a predetermined number of times.

* * * * *